US010544476B2

(12) United States Patent
Sasaki et al.

(10) Patent No.: US 10,544,476 B2
(45) Date of Patent: Jan. 28, 2020

(54) APPARATUS LINE FOR MANUFACTURING SEAMLESS STEEL PIPE AND TUBE AND METHOD OF MANUFACTURING DUPLEX SEAMLESS STAINLESS STEEL PIPE

(71) Applicant: JFE STEEL CORPORATION, Tokyo (JP)

(72) Inventors: Shunsuke Sasaki, Handa (JP); Tatsuro Katsumura, Handa (JP); Hiroki Ushida, Handa (JP); Yasushi Kato, Handa (JP)

(73) Assignee: JFE Steel Corporation, Tokyo (JP)

( * ) Notice: Subject to any disclaimer, the term of this patent is extended or adjusted under 35 U.S.C. 154(b) by 274 days.

(21) Appl. No.: 15/529,842

(22) PCT Filed: Oct. 7, 2015

(86) PCT No.: PCT/JP2015/005095
§ 371 (c)(1),
(2) Date: May 25, 2017

(87) PCT Pub. No.: WO2016/084298
PCT Pub. Date: Jun. 2, 2016

(65) Prior Publication Data

US 2017/0335422 A1 Nov. 23, 2017

(30) Foreign Application Priority Data

Nov. 27, 2014 (JP) ..... 2014-239449

(51) Int. Cl.
*C21D 9/08* (2006.01)
*B21B 3/02* (2006.01)
(Continued)

(52) U.S. Cl.
CPC ..... *C21D 9/085* (2013.01); *B21B 3/02* (2013.01); *B21B 17/08* (2013.01); *B21B 19/04* (2013.01);
(Continued)

(58) Field of Classification Search
CPC ..... C21D 9/085; C21D 2211/001; C21D 2211/005; C21D 6/004; C21D 6/005;
(Continued)

(56) References Cited

U.S. PATENT DOCUMENTS 5,938,865 A * 8/1999 Kondo ..... C21D 8/10 148/593
2009/0218014 A1 9/2009 Hirase et al.
2016/0265076 A1* 9/2016 Sasaki ..... C21D 8/10

FOREIGN PATENT DOCUMENTS

CA 2872342 A1 12/2013
EP 0842715 A1 5/1998
(Continued)

OTHER PUBLICATIONS

International Search Report and Written Opinion for International Application No. PCT/JP2015/005095, dated Dec. 8, 2015—7 Pages.
(Continued)

*Primary Examiner* — Anthony J Zimmer
(74) *Attorney, Agent, or Firm* — RatnerPrestia

(57) ABSTRACT

An apparatus line for manufacturing seamless steel pipes and tubes includes: a heating apparatus for heating a steel raw material; a piercing apparatus for piercing the heated steel raw material thus forming a hollow material; and a rolling apparatus for applying working to the hollow material to form a seamless steel pipe having a predetermined shape. A cooling apparatus is arranged on an exit side of the rolling apparatus. A heated steel raw material is worked by the rolling apparatus after being pierced by the piercing
(Continued)

apparatus, and thereafter, using a surface temperature of a hollow piece before being cooled by the cooling apparatus as a cooling start temperature, the hollow piece is cooled to a cooling stop temperature differing by 50° C. or more from the cooling start temperature and being equal to or above 600° C. at an average cooling speed of 1.0° C./s or more in terms of an outer surface temperature.

10 Claims, 1 Drawing Sheet

(51) Int. Cl.

| | |
|---|---|
| ***B21B 17/08*** | (2006.01) |
| ***B21B 19/04*** | (2006.01) |
| ***B21B 45/00*** | (2006.01) |
| ***B21B 45/02*** | (2006.01) |
| ***C21D 6/00*** | (2006.01) |
| ***C21D 8/10*** | (2006.01) |
| ***C22C 30/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *B21B 45/004* (2013.01); *B21B 45/0209* (2013.01); *B21B 45/0215* (2013.01); *C21D 6/004* (2013.01); *C21D 6/005* (2013.01); *C21D 6/008* (2013.01); *C21D 8/105* (2013.01); *C22C 30/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *B21B 2045/0227* (2013.01); *C21D 2211/001* (2013.01); *C21D 2211/005* (2013.01)

(58) Field of Classification Search
CPC ..... C21D 6/008; C21D 8/105; C21D 9/08; C21D 8/10; C22C 38/44; C22C 38/50; C22C 30/00; C22C 38/001; C22C 38/002; C22C 38/02; C22C 38/04; C22C 38/06; C22C 38/42; C22C 38/54; C22C 38/46; C22C 38/48; C22C 38/58; C22C 38/00; B21B 45/004; B21B 45/0209; B21B 45/0215; B21B 3/02; B21B 45/02; B21B 19/04; B21B 17/08; B21B 2045/0227
See application file for complete search history.

(56) References Cited

FOREIGN PATENT DOCUMENTS

| | | | | |
|---|---|---|---|---|
| EP | 2003216 | A1 | 12/2008 | |
| JP | S5891123 | A | 5/1983 | |
| JP | 03267316 | A | 11/1991 | |
| JP | 07207337 | A | 8/1995 | |
| JP | H0890043 | A | 4/1996 | |
| JP | 4462454 | B1 | 5/2010 | |
| JP | 2013031865 | A | 2/2013 | |
| JP | 2015086412 | A | 5/2015 | |
| WO | 2007114077 | A1 | 10/2007 | |
| WO | WO-2015064006 | A1 * | 5/2015 | ..... C21D 8/10 |

OTHER PUBLICATIONS

Extended European Search Report for European Application No. 15863394.1, dated Nov. 24, 2017, 14 pages.

* cited by examiner

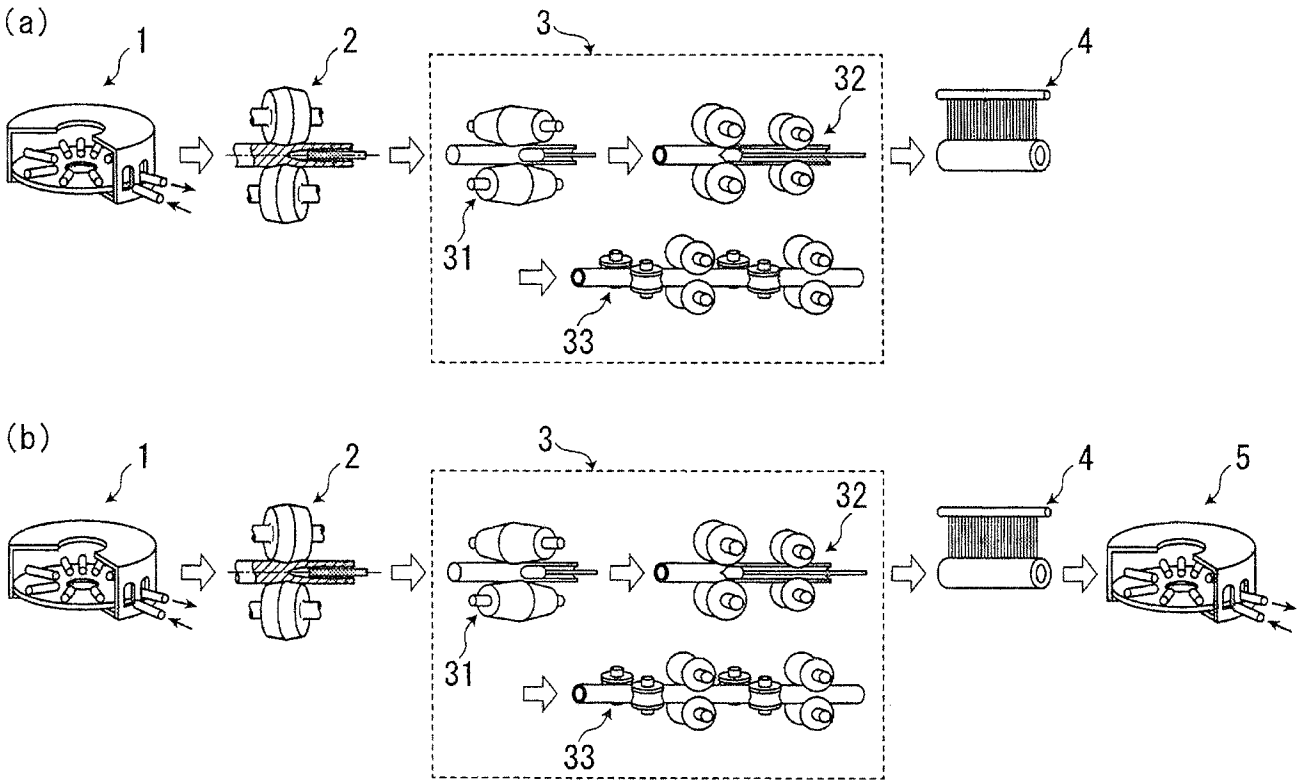
(a)
1
2
3
31
32
33
4
(b)
1
2
3
31
32
33
4
5

APPARATUS LINE FOR MANUFACTURING SEAMLESS STEEL PIPE AND TUBE AND METHOD OF MANUFACTURING DUPLEX SEAMLESS STAINLESS STEEL PIPE

CROSS REFERENCE TO RELATED APPLICATIONS

This is the U.S. National Phase application of PCT/JP2015/005095, filed Oct. 7, 2015, which claims priority to Japanese Patent Application No. 2014-239449, filed Nov. 27, 2014, the disclosures of each of these applications being incorporated herein by reference in their entireties for all purposes.

TECHNICAL FIELD OF THE INVENTION

The present invention relates to the manufacture of seamless steel pipes and tubes, and more particularly to an apparatus line suitable for manufacturing the seamless steel pipes and tubes, and a method of manufacturing a duplex seamless stainless steel pipe having high-strength and excellent low-temperature toughness which uses such an apparatus line. In this specification, "duplex stainless steel" is high Cr (high-chromium) stainless steel having a multiphase structure having at least two phases consisting of a ferrite phase and an austenite phase in a temperature region for hot working of pipes and tubes.

BACKGROUND OF THE INVENTION

Recently, from a viewpoint of a high energy price of crude oil or the like and the exhaustion of oil resource due to the increase in an energy consumption volume on a global scale, there has been observed the vigorous energy resource development with respect to places which had not been noticed such as oil-wells having a large depth (deep layer oil-wells), oil-wells and gas-fields in a severe corrosive environment which are in a so-called sour environment containing hydrogen sulfide or the like, and oil-wells and gas fields in a far north region which is in a severe weather environment. Steel tubes or pipes for oil wells used in these environments are required to be made of materials having all of the following; high strength, excellent corrosion resistance (sour resistance) and excellent low-temperature toughness.

As a steel material having such material properties, conventionally, there has been known an austenite-ferrite-based stainless steel (also referred to as "duplex stainless steel") such as 22% Cr steel and 25% Cr steel. This steel material has been particularly adopted as seamless steel pipes and tubes for oil wells used in a severe corrosive environment which contains a large quantity of hydrogen nitride and is at a high temperature. Duplex stainless steel is ultra low carbon steel of a high Cr system containing approximately 21 to 28% of chromium. As duplex stainless steel, various steel materials containing Mo, Ni, N or the like have been developed, these steel materials are also stipulated as SUS329J1, SUS329J3L, SUS329J4L and the like in JIS Standard (JIS G 4303-4305).

However, duplex stainless steel contains a large amount of alloy element such as Cr or Mo and hence, in an ordinary temperature region for hot working of pipes and tubes and in cooling after hot working, a hard and brittle intermetallic compound (embrittlement phase) is formed so that hot workability is deteriorated and, at the same time, mechanical property and corrosion resistance are also largely lowered. Accordingly, usually, duplex stainless steel is subjected to hot working by being heated to a precipitation temperature of an embrittlement phase or above, and hot working is finished before the embrittlement phase precipitates. Further, for melting an alloy element concentrated in an intermetallic compound which precipitates in a cooling step after hot working into base metal, solution heat treatment is performed where heating is performed at a precipitation temperature of an embrittlement phase or above and rapid cooling is performed thereafter. It is often the case where duplex stainless steel which contains a large amount of alloy element has a multi-phase microstructure even in a temperature region for hot working of pipes and tubes where an embrittlement phase does not precipitate. In this case, for example, in SUS329J4L described previously, duplex stainless steel has a duplex microstructure consisting of a ferrite phase and an austenite phase in a temperature region for hot working of pipes and tubes and hence, when duplex stainless steel is subjected to hot working, strain is concentrated in the ferrite phase where flow stress is relatively low whereby cracks are liable to occur. Accordingly, particularly in the manufacture of a seamless steel pipe having a heavy wall thickness, to suppress the occurrence of a defect at the time of performing hot working, it is necessary to finish working at a high temperature or to suppress strain by reducing an amount of working. In this case, it is difficult to store strain generated by hot working in a wall thickness center portion. When applying of strain is insufficient in hot working, the refinement of crystal grains brought about by strain becomes difficult, and mechanical properties, particularly, low-temperature toughness and yield strength of acquired products are lowered.

To cope with such a problem, for example, patent literature 1 proposes a method of manufacturing a duplex stainless steel pipe or tube having high strength. In a technique disclosed in patent literature 1, in the manufacture of a duplex stainless steel pipe where a hollow piece for cold working of a pipe or tube is prepared by applying hot working or hot working and solution treatment to a duplex stainless steel material which has a chemical composition containing, by mass %, 0.03% or less C, 1% or less Si, 0.1 to 4% Mn, 20 to 35% Cr, 3 to 10% Ni, 0 to 6% Mo, 0 to 6% W, 0% to 3% Cu, 0.15 to 0.60% N, and Fe and an unavoidable impurities as a balance and, thereafter, the hollow piece is subjected to cold working, in a final cold rolling step, cold rolling is performed under a condition where a working ratio Rd at a reduction in area falls within a range of 10 to 80% and satisfies a following formula (1).

$$Rd=\exp[\{ln(MYS)-ln(14.5\times Cr+48.3\times Mo+20.7\times W+6.9\times N)\}/0.195] \quad (1)$$

Here, Rd: working ratio in reduction in area (%), MYS: target yield strength (MPa), Cr, Mo, W and N: contents of respective elements (mass %).

Patent literature states that, according to such a technique, a duplex seamless stainless steel pipe which possesses not only corrosion resistance required by an oil well pipe used in a deep well or in a severe corrosive environment but also target strength can be manufactured by selecting a cold working condition without excessively adding an alloy content.

Patent literature 2 proposes a method of manufacturing duplex stainless steel material having high strength, for example. In a technique disclosed in patent literature 2, cold working with reduction in area of 35% or more is applied to a solution heat treated material of an austenite-ferrite system duplex stainless steel containing Cu and, thereafter, the material is temporarily heated to a temperature region of 800 to 1150° C. at a heating speed of 50° C./s or more and is rapidly cooled and, subsequently, warm pipe and tube working at a temperature of 300 to 700° C. is applied to the material and, thereafter, cold working is applied to the material again or aging treatment is additionally applied to the material at a temperature of 450 to 700° C. In the technique disclosed in patent literature 2, patent literature states that the refinement of the microstructure is acquired by the combination of working and heat treatment so that, even when cold working is applied to the material, an amount of working can be remarkably decreased whereby the deterioration of corrosion resistance can be prevented.

Patent Literature

PTL 1: Japanese Patent No. 4462454

PTL 2: Japanese Unexamined Patent Application Publication No. 07-207337

SUMMARY OF INVENTION

However, in the technique described in patent literature 1, it is necessary to set a large working ratio at a reduction in area by final cold rolling and hence, expensive facility investment becomes necessary to provide a strong cold rolling apparatus for rolling duplex stainless steel having high deformation resistance. Further, with the increase of a working ratio in cold working, there arises particularly a drawback that corrosion resistance of the duplex stainless steel in a high-temperature wet environment where hydrogen nitride exists is lowered. On the other hand, in the technique described in patent literature 2, it is necessary to perform heat treatment plural times including solution heat treatment and heat treatment after cold rolling and hence, the steps become complicated whereby productivity is lowered and, at the same time, a use amount of energy is increased thus giving rise to a drawback that a manufacturing cost is pushed up. Further, when the steel material is heated to 300 to 700° C. at the time of applying warm pipe and tube making property, a large amount of austenite phase precipitates in duplex stainless steel and hence, strain is concentrated in a ferrite phase having small deformation resistance compared to an austenite phase thus also giving rise to a drawback that cracks, defects or the like occur.

It is an object of the present invention to provide a manufacturing apparatus line which can overcome the above-mentioned drawbacks of the prior art, and can manufacture a duplex seamless stainless steel pipe having both high strength and high toughness (for example, high-strength austenite-ferrite system stainless steel pipe) in a stable manner with the occurrence of no cracks or the like while requiring neither strong cold working nor complicated heat treatment and warm pipe and tube making property. Further, it is another object of the present invention to provide a method of manufacturing a duplex seamless stainless steel pipe which can acquire a duplex seamless stainless steel pipe having both high strength and high toughness by making use of such an apparatus line. In this specification, "high strength" means a state where the steel pipe has yield strength (YS) of 588 MPa or more, and "high toughness" means a state where absorbed energy in a Charpy impact test at −10° C. ($vE_{-10}$) is 50 J or more.

The inventors of the present invention, to achieve the above-mentioned objects, have extensively studied various factors which influence strength and toughness of a duplex stainless steel material. As a result, the inventors of the present invention have arrived at an idea that the most effective method of enhancing strength and toughness of a duplex stainless steel material is to make the microstructure of the duplex stainless steel material fine.

The inventors of the present invention have made further studies and have found that, to refine the microstructure of a duplex stainless steel material, it is effective to bring the microstructure of the duplex stainless steel material into the microstructure which is mainly formed of an austenitic phase which precipitates using strain as a nucleation site from a ferrite phase where strain is cumulated by performing the following steps. That is, the steel material is firstly heated to a temperature of ($\delta_A$−300° C.) to ($\delta_A$+100° C.) ($\delta_A$: a temperature where only δ ferrite phase is formed), strain is applied to the steel material by applying hot working to the steel material in the temperature region and, thereafter, cooling is readily applied to the steel material at an average cooling speed of 1.0° C./s or above which is a cooling speed equal to or above air cooling to a temperature region where a large amount of austenite phase precipitates, and the temperature is maintained. Alternatively, when the steel material is super-cooled until a temperature at which an austenite phase largely precipitates or below, the steel material is heated in a temperature region where an austenite phase largely precipitates at a heating speed of 1.0° C./s or above by a heating apparatus, and the temperature is maintained.

The present invention has been completed based on such findings with the addition of further studies. That is, the gist of the present invention includes the following.

(1) An apparatus line for manufacturing seamless steel pipes and tubes which includes:

a heating apparatus for heating a steel, raw material;

a piercing apparatus for piercing the heated steel raw material thus forming a hollow material;

a rolling apparatus for applying hot working to the hollow material thus forming a seamless steel pipe having a predetermined size; and a cooling apparatus arranged on an exit side of the rolling apparatus.

(2) In the apparatus line for manufacturing seamless steel pipes and tubes described in (1), a heat-retention apparatus having a heating function is arranged on an exit side of the cooling apparatus.

(3) In the apparatus line for manufacturing seamless steel pipes and tubes described in (1) or (2), the cooling apparatus has a cooling capability where an average cooling speed at a position on an outer surface of a material to be cooled is set to 1.0° C./s or more.

(4) In the apparatus line for manufacturing seamless steel pipes and tubes described in (2) or (3), the heat retention apparatus has a heat retention capability where an average cooling speed at a position on an outer surface of a material to be cooled is set to 1.0° C./s or less.

(5) In the apparatus line for manufacturing seamless steel pipes and tubes described in (2) or (3), the heat retention apparatus has a heating capability where an average heating speed at a position on an outer surface of a material to be heated is set to 1.0° C./s or more in heating.

(6) In the apparatus line for manufacturing seamless steel pipes and tubes described in (4), the heat retention apparatus has a heating capability where an average heating speed at a position on an outer surface of a material to be heated is set to 1.0° C./s or more in heating.

(7) A method of manufacturing a duplex seamless stainless steel pipe using the apparatus line for manufacturing seamless steel pipes and tubes described in any one of (1) to (6), wherein a steel raw material is heated by the heating apparatus, the hollow material is formed by piercing the steel raw material by the piercing apparatus, the hollow material is formed into a hollow piece by applying hot working by the rolling apparatus, the hollow piece is cooled by the cooling apparatus, and the steel material has the composition which contains, by mass %, 0.050% or less C, 2.00% or less Si, 5.00% or less Mn, 0.05% or less P, 0.03% or less S, 16.0 to 35.0% Cr, 3.0 to 12.0% Ni, 5.0% or less Mo, 0.1% or less Al, 0.5% or less N, and Fe and an unavoidable impurities as a balance, wherein the steel raw material is heated to a temperature of ($\delta_A$−300° C.) to ($\delta_A$+100° C.) by the heating apparatus, hot working is applied to the rolling apparatus, and using a surface temperature of the hollow piece before being cooled by the cooling apparatus as a cooling start temperature, the cooling apparatus cools the hollow piece to a cooling stop temperature having a temperature difference of at least 50° C. or more from the cooling start temperature and being equal to or above 600° C. at an average cooling speed of 1.0° C./s or more in terms of an outer surface temperature.

(8) In the method of manufacturing a duplex seamless stainless steel pipe in (7), the hollow piece is made to pass through the heat retention apparatus after cooling.

(9) In the method of manufacturing a duplex seamless stainless steel pipe in claim (8), the treatment which makes the hollow piece pass through the inside of the heat retention apparatus is adjusted such that cooling is performed at an average cooling speed of 1.0° C./s or less at a position on an outer surface of the hollow piece.

(10) In the method of manufacturing a duplex seamless stainless steel pipe in (8) or (9), the average heating speed at the position on the outer surface of the hollow piece by the heat retention apparatus is set to 1.0° C./s or more.

(11) In the method of manufacturing a duplex seamless stainless steel pipe in any one of (7) to (10), the steel material further contains, in addition to the above-mentioned composition, by mass %, one, two or more kinds of elements selected from a group consisting of 3.0% or less Nb, 0.1% or less Ti, 3.0% or less V, 0.5% or less Zr, 3.5% or less W, 3.5% or less Cu, 0.05% or less REM, 0.01% or less B, and 0.1% or less Ca.

According to the present invention, a duplex seamless stainless steel pipe having both high strength and high toughness can be easily manufactured in a stable manner with the occurrence of no cracks or the like and hence, the present invention can acquire industrially extremely excellent advantageous effects. Further, according to the present invention, the microstructure of the steel pipe can be made fine to a center portion with a relatively small amount of working and hence, the present invention can acquire an advantageous effect that even a duplex seamless stainless steel pipe where an amount of working at a wall thickness center position cannot be increased can also enhance both strength and low-temperature toughness thereof. Here, "heavy wall thickness" means a state where a wall thickness falls within a range of 13 to 100 mm.

BRIEF DESCRIPTION OF THE DRAWING

The drawing is an explanatory view schematically showing one example of an apparatus line for manufacturing seamless steel pipes and tubes according to the present invention.

DETAILED DESCRIPTION OF EMBODIMENTS OF THE INVENTION

The apparatus line used in the present invention is an apparatus line which can apply working to a heated steel raw material, and thereafter, can cool the steel raw material within a proper temperature range thus manufacturing a seamless steel pipe having a predetermined size. One preferred example of the apparatus line used in the present invention is shown in the drawing. The apparatus line for manufacturing seamless steel pipes and tubes of the present invention is either (a) an apparatus line where a heating apparatus 1, a piercing apparatus 2, a rolling apparatus 3 and a cooling apparatus 4 are arranged in this order, and (b) an apparatus line where a heating apparatus 1, a piercing apparatus 2, a rolling apparatus 3, a cooling apparatus 4 and a heat retention apparatus 5 are arranged in this order.

As the heating apparatus 1 which can be used in the present invention, it is possible to adopt any one of ordinary heating furnaces which can heat a steel raw material such as round cast billets or round steel billets to a predetermined temperature, for example, a rotary hearth type heating furnace or a walking-beam type heating furnace. Further, an induction heating type heating furnace may be used as the heating apparatus 1.

As the piercing apparatus 2 used in the present invention, one can use any piercing apparatus which can form a hollow material by applying piercing to a heated steel raw material. For example, any usually known piercing apparatus such as a Mannesmann type skew rolling type piercing apparatus which uses barrel type rolls or a hot-extruded type piercing apparatus can be used.

As the rolling apparatus 3 used in the present invention, any rolling apparatus can be used provided that the rolling apparatus can form a seamless steel pipe having a predetermined shape (hereinafter referred to also as "hollow piece") by applying working to the hollow material. It is preferable to use the rolling apparatus 3 depending on a purpose of use. For example, any ordinary known rolling apparatus can be used including a rolling apparatus where an elongator 31, a plug mill 32 which stretches the pierced hollow material into a thin and elongated shape, a reeler which makes both outer and inner surfaces of the hollow piece smooth(not shown in the drawing) and a sizing mill 33 which shapes the hollow piece into a predetermined size are arranged in this order and a rolling apparatus where a mandrel mill for forming a hollow material into a hollow piece having a predetermined size (not shown in the drawing), and a stretch reducing mill (not shown in the drawing) for adjusting an outer diameter and a wall thickness by applying a slight reduction are arranged. It is preferable to use the elongator or the mandrel mill which allows the applying of a large amount of working.

The cooling apparatus 4 used in the present invention is arranged on an exit side of the rolling apparatus 3 for cooling the hollow piece to a proper temperature range by suppressing recovery and a phase transformation of a ferrite phase in which strain is cumulated. It is unnecessary to limit the type of the cooling apparatus 4 used in the present invention provided that the cooling apparatus 4 can cool the hollow piece immediately after rolling at a desired cooling speed or more. As the cooling apparatus which can relatively easily ensure a desired cooling speed, it is desirable to provide an apparatus of a type which cools a hollow piece by spraying or supplying cooling water, compressed air or mist to outer and inner surfaces of the hollow piece which is a material to be cooled.

The cooling apparatus 4 used in the present invention may preferably be a cooling apparatus which has, in the manufacture of a steel pipe having a duplex stainless steel composition, cooling capability by which it is possible to acquire at least an average cooling speed of 1.0° C./s or more at a position on an outer surface of a material to be cooled (hollow piece) to acquire phase distributions in a nonequilibrium state. When cooling capability of the cooling apparatus is insufficient so that only cooling with a cooling speed lower than the average cooling speed is possible, the recovery and a phase change of a ferrite phase where strain is cumulated progresses and hence, the phase distributions in a nonequilibrium state cannot be acquired whereby the refinement of microstructure cannot be acquired. Although it is unnecessary to particularly limit an upper limit of a cooling speed, it is preferable to set the upper limit of the cooling speed to 30° C./s from a viewpoint of prevention of cracks and bend caused by a thermal stress.

In the present invention, it is preferable that the apparatus line where the heat retention apparatus 5 is disposed on an exit side of the cooling apparatus 4. In the present invention, the heat retention apparatus 5 is disposed for lowering a cooling speed after a material to be cooled (hollow piece) is cooled to a predetermined temperature by the cooling .apparatus 4. In case of the duplex stainless steel pipe, when cooling of the steel pipe in an austenite generation temperature region is too fast, a nonequilibrium ferrite phase is cooled without generating an $\alpha \rightarrow \gamma$ transformation so that the formation of fine austenite grains is not acquired whereby desired refinement of microstructure cannot be achieved. It is preferable that the heat retention apparatus 5 have heat insulation capacity capable of adjusting an average cooling speed at a position on an outer surface of a material to which heat retention is applied (hollow piece) to at least 1° C./s or less. Further, it is preferable that the heat retention apparatus 5 have heating property capable of adjusting an average heating speed at a position on an outer surface of a material to which heating is applied (hollow piece) to 1.0° C./s or more.

Next, the explanation is made with respect to the method of manufacturing a heavy-wall-thickness duplex seamless stainless steel pipe for an oil well having high-strength, excellent corrosion resistance, and excellent low-temperature toughness by using the above-mentioned apparatus line for manufacturing seamless steel pipes and tubes.

The steel raw material is heated by the heating apparatus 1, and thereafter, a hollow material is formed by piercing the steel raw material, and then, a hollow piece is formed by applying hot working to the hollow material by the rolling apparatus 3. Then, the hollow piece is cooled by the cooling apparatus 4, or further, treatment where the hollow piece is made to pass through the heat retention apparatus 5 is applied to the hollow piece after such cooling thus forming a seamless steel pipe having a predetermined size.

As a steel raw material to be used in the method, any one of steel raw materials having the duplex stainless steel composition stipulated as SUS329J1, SUS329J3L, SUS329J4L and the like in JIS G 4303-4305 is applicable. The steel material has the composition which contains, by mass %, 0.05% or less C, 2.0% or less Si, 5.0% or less Mn, 0.05% or less P, 0.03% or less S, 3.0 to 12.0% Ni, 16.0 to 35.0% Cr, 5.0% or less Mo, 0.1% or less Al, 0.5% or less N, and Fe and unavoidable impurities as a balance.

Firstly, the reasons for limiting the steel raw material to the preferred composition are explained. Unless otherwise specified, mass % in the composition is simply indicated by "%" hereinafter.

C: 0.05% or less

Although C is an element which increases strength of steel, C lowers the corrosion resistance of steel. Accordingly, it is desirable to set the content of C as small as possible. However, the excessive reduction of C brings about a sharp increase of a manufacturing cost.

Accordingly, in the present invention, the content of C is limited to 0.05% or less. The content of C is preferably limited to 0.03% or less.

Si: 2.0% or less

Si is an element which functions as a deoxidant and has a function of increasing strength of steel. To enable the steel pipe to acquire such an effect, it is desirable to set the content of Si to 0.01% or more. On the other hand, when the content of Si is large and exceeds 2.00%, ductility is lowered or the precipitation of an intermetallic compound is accelerated thus lowering corrosion resistance. Accordingly, the content of Si is limited to 2.0% or less. The content of Si is preferably limited to a value which falls within a range of 0.5% to 1.5%.

Mn: 5.0% or less

Mn is an austenite stabilizing element, and properly adjusts fractions of duplex microstructure, and contributes to the enhancement of corrosion resistance and workability of duplex stainless steel material. To acquire such advantageous effects, it is desirable that the content of Mn be 0.01% or more. However, when the content of Mn exceeds 5.0%, hot workability and corrosion resistance are lowered. Accordingly, the content of Mn is limited to 5.0% or less. The content of Mn is preferably limited to a value which falls within a range of 0.5 to 2.0%.

P: 0.05% or less

P is an element which is mixed into steel as impurities, and is liable to generate segregation in a grain boundary or the like thus causing lowering of corrosion resistance and hot workability. Accordingly, although it is desirable to decrease the content of P as small amount as possible, the presence of less than or equal to 0.05% of P is permissible. However, the excessive reduction of P causes a sharp rise of a material cost and hence, it is desirable to set the content of P to 0.002% or more. Accordingly, the content of P is limited to 0.05% or less. The content of P is preferably limited to 0.02% or less.

S: 0.03% or less

S is, in the same manner as P, an element which is mixed in steel as impurities, and is present in steel as a sulfide-based inclusion and lowers ductility, corrosion resistance and hot workability of steel. Accordingly, although it is preferable to decrease the content of S as small amount as possible, the presence of less than or equal to 0.03% of S is permissible. However, the excessive reduction of S causes a sharp rise of a material cost and hence, it is desirable to set the content of S to 0.002 or more. Accordingly, the content of S is limited to 0.03% or less. The content of S is preferably set to 0.005% or less.

Ni: 3.0 to 12.0%

Ni is an austenite stabilizing element, and properly adjusts fractions of duplex microstructure, and contributes to the enhancement of corrosion resistance and workability of duplex stainless steel material. To acquire such advantageous effects, it is necessary to set the content of Ni to 3.0% or more. On the other hand, when the content of Ni exceeds 12.0%, an austenite phase is excessively increased so that the maintenance of desired duplex phase microstructure becomes difficult. Accordingly, the content of Ni is limited to a value which falls within a range of 3.0 to 12.0%. The content of Ni is preferably limited to a value which falls within a range of 5.0 to 9.0%.

Cr: 16.0 to 35.0%

Cr is an element which enhances the corrosion resistance. Cr is also a ferrite stabilizing element and is a main element for deciding fractions of duplex phase microstructure consisting of a ferrite phase and an austenite phase. It is necessary for steel to set the content of Cr to 16.0% or more to acquire such an advantageous effect. On the other hand, when the content of Cr becomes large and exceeds 35.0%, the formation of an intermetallic compound such as a $\sigma$ phase or a $\chi$ phase is accelerated thus giving rise to lowering of corrosion resistance of steel. Accordingly, the content of Cr is limited to a value which falls within a range of 16.0 to 35.0%. The content of Cr is preferably set to a value which falls within a range of 16.0 to 28.0%.

Mo: 5.0% or less

Mo is an element which enhances corrosion resistance of steel, and it is desirable that the content of Mo is set to 1.0% or more to acquire such an advantageous effect. On the other hand, when the content of Mo exceeds 5.0%, the precipitation of an intermetallic compound is accelerated and hence, corrosion resistance and hot workability are lowered. Accordingly, the content of Mo is limited to 5.0% or less. The content of Mo is preferably set to a value which falls within a range of 2.0 to 4.0%.

Al: 0.1% or less

Al is an element which functions as a deoxidant, and it is desirable for steel that the content of Al be set to 0.001% or more to acquire such an advantageous effect. However, when the content of Al is large and exceeds 0.1%, an amount of oxide-based inclusion is increased and hence, cleanliness is lowered. Accordingly, the content of. Al is limited to a 0.1% or less. The content of Al is preferably set to a value which falls within a range of 0.001 to 0.050%.

N: 0.5% or less

N is a strong austenite stabilizing element, and also contributes to the enhancement of corrosion resistance. It is desirable for steel that the content of N be set to 0.050% or more to acquire such an advantageous effect. However, when the content of N exceeds 0.5%, an austenite phase is excessively increased so that the maintenance of the desired duplex phase microstructure becomes difficult. Accordingly, the content of N is limited to 0.5% or less.

In addition to the above-mentioned composition, steel raw material may contain one or two or more kinds selected from a group consisting of 3.0% or less Nb, 0.1% or less Ti, 3.0% or less V, 0.5% or less Zr, 3.5% or less W, 3.5% or less Cu, 0.05% or less REM, 0.01% or less B, and 0.1% or less Ca.

All of Nb, Ti, V and Zr are elements which effectively contribute to the enhancement of strength and toughness as well as the enhancement of corrosion resistance. Steel raw material can selectively contain one kind or two or more kinds of these elements when desired. To acquire these advantageous effects, it is desirable that steel raw material contain 0.01% or more Nb, 0.01% or more Ti, 0.01% V, 0.01% or more Zr. On the other hand, even when the content of Nb exceeds 3.0%, the content of Ti exceeds 0.1%, the content of V exceeds 3.0% or the content of Zr exceeds 0.5%, toughness and hot workability are lowered. Accordingly, when steel raw material contains these elements, it is preferable to limit the contents of these elements such that the content of Nb is 3.0% or less, the content of Ti is 0.1% or less, the content of V is 3.0% or less, and the content of Zr is 0.5% or less.

All of W, Cu and REM are elements which effectively contribute to the enhancement of corrosion resistance. Steel raw material can selectively contain one kind or two or more kinds of these elements when desired. To acquire these advantageous effects, it is desirable that steel raw material contain 0.01% or more W, 0.01% or more Cu, 0.005% or more REM. On the other hand, when the content of W exceeds 3.5%, the content of Cu exceeds 3.5% or the content of REM exceeds 0.05%, toughness is lowered. Accordingly, when steel raw material contains these elements, it is preferable to limit the contents of these elements respectively such that the content of W is 3.5% or less, the content of Cu is 3.5% or less, and the content of REM is 0.05% or less.

Both B and Ca are elements which contribute to the suppression of formation of a defect during hot working, and steel raw material can selectively contain one kind or two or more kinds of these elements in addition to the above-mentioned composition. To acquire such an advantageous effect, it is desirable that steel raw material contain 0.0001% B and 0.001% Ca. On the other hand, when the content of B exceeds 0.01% or the content of Ca exceeds 0.1%, toughness is lowered. Accordingly, when steel raw material contains these elements, it is preferable to limit the contents of these elements such that the content of B is 0.01% or less, and the content of Ca is 0.1% or less.

A balance other than the above-mentioned components is formed of Fe and unavoidable impurities. As unavoidable impurities, 0.0050% or less O (oxygen) is permissible.

Any ordinary methods can be used as the method of manufacturing steel raw material used in the present invention, and it is unnecessary to particularly limit the method of manufacturing steel raw material used in the present invention. For example, it is preferable that molten steel having the predetermined duplex stainless steel composition is made by a converter, an electric furnace, a melting furnace or the like, or molten steel is further subjected to secondary refining by an AOD apparatus, a VOD apparatus or the like and, thereafter, molten steel is formed into cast pieces such as slabs or billets by a continuous casting method or molten steel is formed into cast pieces such as slabs or billets by an ingot molding-rolling. Homogenizing annealing at a high temperature may be applied to steel raw material in advance.

Firstly, heat treatment is applied to steel raw material.

In the heat treatment, steel raw material is loaded into the heating apparatus 1, and steel raw material is heated to a temperature (heating temperature) of ($\delta_A$−300° C.) to ($\delta_A$+100° C.)

Heating temperature: ($\delta_A$−300° C.) to (($\delta_A$+100° C.)

When a heating temperature is below ($\delta_A$−300° C.), the refinement of microstructure which makes use of the transformation from a ferrite phase cannot be achieved. Further, an austenite phase fraction is increased and hence, working of steel raw material becomes difficult due to the increase of a load or lowering of hot ductility. On the other hand, when the heating temperature is ($\delta_A$+100° C.) or above, cumulation of strain by working becomes difficult. Accordingly, the heating temperature of a steel raw material is limited to a temperature which falls within a range of ($\delta_A$−300° C.) to ($\delta_A$+100° C.). The heating temperature of steel raw material may preferably falls within a range of 1100 to 1300° C. $\delta_A$ may be obtained using general-use equilibrium state calculation software, or $\delta_A$ may be obtained such that a thermal expansion curve is measured, and $\delta_A$ may be obtained from an inflection point of the thermal expansion curve due to the completion of a δ ferrite phase transformation.

The steel raw material to which heat treatment is applied is formed into a hollow material by piercing the steel raw material by the piercing apparatus 2 and, thereafter, hot working is applied to the hollow material by the rolling apparatus 3 thus manufacturing a seamless steel pipe (hollow piece) having a predetermined size. It is sufficient for hot working applied to the steel raw material that a hollow piece having a predetermined size can be formed, and any ordinary working conditions are applicable and, it is unnecessary to particularly limit the working condition. In the present invention, although the desired refinement of microstructure can be acquired even with a relatively small amount of working (reduction), it is preferable to set a cumulative working amount to at least 10% or more from a viewpoint of the refinement of microstructure.

The hollow piece is subjected to cooling treatment immediately after hot working is applied to the steel raw material.

In the cooling treatment, by making use of the cooling apparatus 4, the hollow piece is cooled to a cooling stop temperature having a temperature difference of at least 50° C. or more from a cooling start temperature and being 600° C. or above at an average cooling speed of 1.0° C./s or more in terms of an outer surface temperature of the hollow piece.

Average cooling speed: 1.0° C./s or more

In an aspect of the present invention, in the cooling treatment, to acquire a ferrite phase in a super-cooled state (phase distribution in a non-equilibrium state) where strain is cumulated, a material to be cooled (hollow piece) is cooled at an average cooling speed of at least 1.0° C./s or more at a position on an outer surface of the material to be cooled (hollow piece). When the material to be cooled cannot be cooled only at a cooling speed lower than the above-mentioned average cooling speed, the above-mentioned strain is restored, and at the same time, an austenite phase and other precipitation phases precipitate so as to approach an equilibrium state from a ferrite phase grain boundary or grains and hence, a phase distribution in a non-equilibrium state cannot be acquired whereby the refinement of microstructure cannot be achieved. Although it is unnecessary to particularly limit an upper limit of cooling speed, from a viewpoint of preventing cracks or bending caused by a thermal stress, it is preferable to set the upper limit of the cooling speed to 50° C./s. The cooling speed is preferably set to a value which falls within a range from 3 to 30° C./s.

Cooling temperature range: 50° C. or more

A cooling temperature range, that is, a temperature difference between a cooling start temperature and a cooling stop temperature is set to at least 50° C. or more in terms of a temperature on an outer surface of a material to be cooled (hollow piece). When the cooling temperature range is below 50° C., a fraction of a super-cooled ferrite phase is small and hence, phase fractions in a remarkable non-equilibrium state cannot be ensured whereby the desired refinement of microstructure cannot be achieved. Accordingly, the cooling temperature range is limited to 50° C. or more. The larger the cooling temperature range, the more easily the fractions in a non-equilibrium state can be ensured. It is preferable that the cooling temperature range is set to 100° C. or above. The cooling start temperature is a temperature of an outer surface of the material to be cooled (hollow piece) before cooling is started.

Cooling stop temperature: 600° C. or above

When the cooling stop temperature is below 600° C., the diffusion of elements is delayed and hence, a phase transformation (α→γ transformation) which occurs during a period where the temperature is held thereafter is delayed whereby a long time is required to ensure desired refined microstructure thus lowering productivity. Accordingly, the cooling stop temperature is limited to 600° C. or above at a wall thickness center temperature of a material to be cooled (hollow piece). It is preferable that the cooling stop temperature be set to 700° C. or above.

As described previously, it is necessary that the cooling stop temperature is 600° C. or above and the temperature difference between the cooling start temperature and the cooling stop temperature is 50° C. or above and hence, a lower limit of the cooling start temperature is 650° C. or above, preferably 900° C. or above, and more preferably 1150° C. or above.

Cooling speed after stopping cooling: 1.0° C./s or less

When cooling of a material to be cooled (hollow piece) becomes cooling where an average cooling speed at a position on an outer surface of the material to be cooled (hollow piece) after cooling by the cooling apparatus 4 is stopped exceeds 1.0° C./s, it is preferable to adjust the average cooling speed to 1.0° C./s or less by loading the material to be cooled (hollow piece) into the heat retention apparatus 5 provided on an exit side of the cooling apparatus 4. When the average cooling speed at the position on the outer surface of the material to be cooled (hollow piece) after stopping cooling becomes excessively fast exceeding 1.0° C./s, the precipitation of a second phase becomes insufficient so that desired fractions cannot be acquired when products are manufactured.

Heating speed after stopping cooling: 1.0° C./s or more

When a cooling stop temperature becomes lower than 600° C., by heating a material to be heated (hollow piece) to a temperature region of 600° C. or above and below 1150° C. at a heating speed of 1.0° C./s or more at a temperature on an outer surface of the material to be heated (hollow piece) using the heat retention apparatus 5, it is possible to acquire the substantially same advantageous effects as the case where the cooling is performed under a condition that cooling stop temperature does not become lower than 600° C. Although it is unnecessary to particularly define an upper limit of the heating speed, it is preferable to set the heating speed to 50° C./s or below for uniformly heating the whole material to be heated (hollow piece).

It is sufficient that cooling treatment according to the present invention which is performed after hot working is performed after hot working performed by at least one rolling mill mounted on the rolling apparatus 3. It is ascertain that, provided that cooling treatment is performed within a temperature region below 1150° C. where acquired minute grain structure does not become coarse, there arises no problem even when reheating is performed and, further, hot working (size determining working by a sizing mill, a stretch reducing mill or the like) is performed.

Next, the present invention is described further based on an example.

EXAMPLE

Molten steels having the compositions shown in Table 1 were prepared by melting in a vacuum melting furnace, and round billets having a diameter of 63 mm were produced through hot rolling and machining. Next, using the apparatus line for manufacturing a seamless steel pipe shown in the drawing, these steel raw materials were loaded into the heating apparatus 1 thus heating the steel raw materials at heating temperatures shown in Table 2. After holding the steel raw materials in the heating apparatus 1 for a fixed time (60 min) and, thereafter, hollow materials (wall thickness: 20 mm) were produced by applying piercing to the steel raw materials using a barrel type Mannesmann piercing apparatus 2. Then, hot working is applied to the steel raw materials using the rolling apparatus 3, and thereafter, using the cooling apparatus 4 where cooling water supplied by spraying is used as a refrigerant, the hollow materials were cooled to cooling stop temperatures shown in Table 2 at average cooling speeds shown in Table 2 thus manufacturing seamless steel pipes (outer diameter: 74 mm, wall thickness: 13 to 16 mm). After cooling by the cooling apparatus 4, the seamless steel pipes were cooled by natural cooling (0.1 to 0.5° C./s). When the cooling stop temperatures became lower than predetermined temperatures, the seamless steel pipes were inserted into the heat retention apparatus 5 and were heated to predetermined temperatures at a heating speed of 1.2° C./s. The obtained seamless steel pipes were subjected to proper quenching and tempering treatment (QT treatment) or were subjected to solution treatment where the seamless steel pipes were heated at a temperature which falls within a range of 1050 to 1150° C., and thereafter, were rapidly cooled.

Specimens were sampled from the acquired seamless steel pipes and the structure observation and a tensile test were carried out. The following testing methods were used.

(1) Structure Observation

The presence or the non-presence of cracks in end portions of the steel pipes was observed by naked eye using the obtained seamless steel pipes. When cracks were generated, the degree of cracks was evaluated. The evaluation "present (large)" was given when the number of places where the cracks occurred was 5 or more, and the evaluation "present (small)" was given when the number of places where the cracks occurred was less than 5.

Next, specimens for structure observation were sampled from the obtained steel pipes, cross sections (C cross sections) orthogonal to the pipe longitudinal direction were polished and corroded (corrosion liquid: Villella liquid). Next, the microstructures were observed using an optical microscope (magnification: 200 times) or a scanning electron microscope (magnification: 1000 times), and the microstructures were imaged and kinds of microstructures were measured using an image analysis. As an index for determining whether or not the microstructures were refined, the number of phase boundaries which intersect with a straight line of a unit length was measured from the microstructure photographs. In Table 3, numerical values of the phase boundaries of the obtained respective steel pipes were indicated as ratios with respect to reference values (phase boundary number ratios) using the numerical values of the phase boundaries of the steel pipes where cooling after hot working was performed by natural cooling (cooling speed: 0.8° C./s) among pipes of the same kind as references (1.00).

(2) Tensile Test

Round bar type tensile specimens (parallel portion: 6 mmϕ×G.L. 20 mm) were sampled from the obtained seamless steel pipes such that the pipe-axis direction is aligned with the pulling direction. The tensile test was carried out in accordance with the provision of JIS Z 2241, and yield strength YS was obtained with respect to each specimen. Strength at the elongation of 0.2% was set as the yield strength. A value (%) obtained by dividing the difference between the obtained yield strength and yield strength (reference yield strength) of a steel pipe of the same kind where cooling after hot working is natural cooling (cooling speed: 0.8° C./S) by the reference yield strength, that is, ΔYS (%) (=(yield strength-reference yield strength)×100/(reference yield strength)) was calculated, and a strength enhancement ratios of the respective steel pipes were evaluated. The evaluation "x bad" was given to the seamless pipes where the yield strength YS became lower than 588 MPa, and the evaluation "o good" was given to the seamless steel pipes where the yield strength YS became larger than 588 MPa.

(3) Charpy Impact Test

Charpy impact specimens (V-notched specimens) were sampled from the obtained seamless steel pipes such that the longitudinal direction of the specimen becomes the direction (C direction) orthogonal to the pipe axis direction, and the Charpy impact test was carried out in accordance with the provision stipulated in JIS Z 2242, and absorbed energy $vE_{-10}$ (J) at a test temperature of −10° C. were acquired. Three specimens were used in each test, an arithmetic mean of absorbed energy of the respective specimens was obtained, and the arithmetic mean value was set as a value of the steel pipe. A value (%) obtained by dividing the difference between the absorbed energy value of each steel pipe obtained as the result of the test and an absorbed energy value (reference absorbed energy value) of a steel pipe of the same kind where cooling after hot working was natural cooling (cooling speed: 0.8° C./s) by reference absorbed energy value, that is, ΔE (%) (=(absorbed energy value−reference absorbed energy value) ×100/(reference absorbed energy value)) was calculated, and absorbed energy enhancement ratios of the respective steel pipes were evaluated.

The obtained result is shown in Table 3.

All present invention examples succeeded in manufacturing the duplex seamless stainless steel pipes which can realize the refinement of the microstructure thereof, can acquire an effect of enhancing strength thereof by 2.5% or more compared to the a steel pipe manufactured by performing cooling by natural cooling after hot working, can acquire an effect of enhancing absorbed energy thereof by 20% or more compared to a steel pipe manufactured by performing cooling by natural cooling after hot working, and possess high strength (yield strength YS: 588 MPa or more) without causing the occurrence of cracks. On the other hand, the comparative examples which do not fall within the scope of the present invention cannot realize the refinement of microstructure and hence, the comparative examples cannot ensure desired strength and desired low-temperature toughness or the occurrence of cracks was recognized in the comparative examples.

TABLE 1

| Steel | Chemical composition (mass %) | | | | | | | | | | | |
|---|---|---|---|---|---|---|---|---|---|---|---|---|
| No. | C | Si | Mn | P | S | Cr | Ni | Mo | Al | N | Nb, Ti, V, Zr | W, Cu, B, Ca, REM |
| A | 0.025 | 0.28 | 0.25 | 0.0021 | 0.0004 | 16.2 | 4.2 | 2.2 | 0.040 | 0.038 | Nb: 0.11, V: 0.22, Zr: 0.03 | W: 1.0, Cu: 1.1, Ca: 0.001 |
| B | 0.018 | 0.85 | 0.50 | 0.0018 | 0.0003 | 23.2 | 5.9 | 2.8 | 0.010 | 0.071 | Ti: 0.03, Nb: 0.05 | W: 2.5, Cu: 1.5, B: 0.005 |

TABLE 1-continued

| Steel | Chemical composition (mass %) | | | | | | | | | | | |
|---|---|---|---|---|---|---|---|---|---|---|---|---|
| No. | C | Si | Mn | P | S | Cr | Ni | Mo | Al | N | Nb, Ti, V, Zr | W, Cu, B, Ca, REM |
| C | 0.018 | 0.86 | 0.52 | 0.0019 | 0.0003 | 25.5 | 6.9 | 3.3 | 0.030 | 0.500 | Ti: 0.03, Nb: 0.05 | W: 2.8, Cu: 1.5, Ca: 0.001 |
| D | 0.011 | 0.25 | 0.45 | 0.0015 | 0.0003 | 35.0 | 12.0 | 5.0 | 0.030 | 0.115 | Nb: 0.10, V: 0.10 | W: 3.0, REM: 0.006 |

TABLE 2

| Steel pipe No. | Steel No. | $\delta_A$ (° C.) | Heating Heating temperature (° C.) | Hot working Wall thickness reduction ratio (%) | Wall thickness (mm) | Cooling after hot working: Cooling start temperature (° C.) | Average cooling speed (° C./s) | Cooling stop temperature (° C.) |
|---|---|---|---|---|---|---|---|---|
| 1 | A | 1345 | 1250 | 20 | 16 | 1200 | 2.5 | 1155 |
| 2 | A | | 1250 | 35 | 13 | 1200 | 3.3 | 1140 |
| 3 | A | | 1250 | 10 | 18 | 1200 | 4.4 | 950 |
| 4 | A | | 1250 | 20 | 16 | 1200 | 5.3 | 615 |
| 5 | A | | 1250 | 20 | 16 | 1200 | 5.5 | 580 |
| 6 | A | | 1250 | 20 | 16 | 1200 | 4.3 | 25 |
| 7 | A | | 1250 | 20 | 16 | 1200 | 2.3 | 1145 |
| 8 | A | | 1250 | 20 | 16 | 1100 | 3.4 | 990 |
| 9 | A | | 1250 | 20 | 16 | 750 | 4.1 | 605 |
| 10 | A | | 1250 | 20 | 16 | 1200 | 0.8 | 950 |
| 11 | B | 1280 | 1350 | 20 | 16 | 1270 | 3.8 | 950 |
| 12 | B | | 1350 | 20 | 16 | 1270 | 0.8 | 925 |
| 13 | C | 1290 | 1250 | 20 | 16 | 1200 | 3.5 | 955 |
| 14 | C | | 1250 | 20 | 16 | 1200 | 0.8 | 935 |
| 15 | D | 1260 | 1250 | 20 | 16 | 1200 | 3.6 | 1080 |
| 16 | D | | 1250 | 20 | 16 | 1200 | 0.8 | 1075 |

| Steel pipe No. | Cooling after hot working: Cooling temperature range (° C.) | Retention/heating: Presence or non presence (cooling or heating average speed (° C./s)) | Heat treatment: Solution treatment temperature (° C.) | Quenching and tempering temperatures Q/T(° C.) | Remarks |
|---|---|---|---|---|---|
| 1 | 45 | not present | | 900/600 | comparative example |
| 2 | 60 | not present | | 900/600 | present invention example |
| 3 | 250 | not present | | 900/600 | present invention example |
| 4 | 585 | not present | | 900/600 | present invention example |
| 5 | 620 | not present | | 900/600 | comparative example |
| 6 | 1175 | heating (1.2) | | 900/600 | present invention example |
| 7 | 55 | not present | | 900/600 | present invention example |
| 8 | 110 | not present | | 900/600 | present invention example |
| 9 | 145 | not present | | 900/600 | present invention example |
| 10 | 250 | not present | | 900/600 | comparative example |
| 11 | 320 | not present | 1030 | | present invention example |
| 12 | 345 | not present | 1030 | | comparative example |
| 13 | 245 | not present | 1050 | | present invention example |
| 14 | 265 | not present | 1050 | | comparative example |
| 15 | 120 | not present | 1150 | | present invention example |
| 16 | 125 | not present | 1150 | | comparative example |

* Underlined values fall outside the scope of the present invention.

TABLE 3

| Steel pipe No. | Steel No. | Microstructure: Kinds* | Phase boundary number ratio | Tensile property: YS ≥ 558 MPa | ΔYS** | ΔE*** | Toughness: Cracks during working | Remarks |
|---|---|---|---|---|---|---|---|---|
| 1 | A | F + M | 0.45 | ○ | −2.0 | −33.3 | not present | comparative example |
| 2 | A | F + M | 1.65 | ○ | 2.7 | 57.1 | not present | present invention example |
| 3 | A | F + M | 3.95 | ○ | 6.1 | 81.0 | not present | present invention example |
| 4 | A | F + M | 1.85 | ○ | 4.7 | 69.0 | not present | present invention example |
| 5 | A | F + M | 0.95 | ○ | 3.4 | −11.9 | present (small) | comparative example |
| 6 | A | F + M | 2.18 | ○ | 6.1 | 81.0 | not present | present invention example |

TABLE 3-continued

| Steel pipe No. | Steel No. | Microstructure Kinds* | Phase boundary number ratio | Tensile property YS ≥ 558 MPa | ΔYS** | Toughness ΔE*** | Cracks during working | Remarks |
|---|---|---|---|---|---|---|---|---|
| 7 | A | F + M | 1.25 | ○ | 3.4 | 40.5 | not present | present invention example |
| 8 | A | F + M | 3.50 | ○ | 6.2 | 76.2 | not present | present invention example |
| 9 | A | F + M | 1.55 | ○ | 3.4 | 64.3 | not present | present invention example |
| 10 | A | F + M | 1.00 | ○ | reference | reference | present (large) | comparative example |
| 11 | B | F + A | 4.95 | ○ | 4.4 | 22.7 | not present | present invention example |
| 12 | B | F + A | 1.00 | x | reference | reference | present (large) | comparative example |
| 13 | C | F + A | 3.91 | ○ | 6.3 | 22.2 | not present | present invention example |
| 14 | C | F + A | 1.00 | x | reference | reference | present (large) | comparative example |
| 15 | D | F + A | 4.91 | ○ | 6.7 | 93.3 | not present | present invention example |
| 16 | D | F + A | 1.00 | ○ | reference | reference | present (large) | comparative example |

*F: ferrite, A: austenite, M: martensite (containing residual γ)
**ΔYS (%) = (yield strength − reference yield strength) × 100/(reference yield strength)
***ΔE (%) = (absorbed energy value − reference absorbed energy value) × 100/(reference absorb energy value)

REFERENCE SIGNS LIST

1: heating apparatus
2: piercing apparatus
3: rolling apparatus
4: cooling apparatus
5: heat retention apparatus
31: elongator
32: plug mill
33: sizing mill

The invention claimed is:

1. A method of manufacturing duplex seamless stainless steel pipes and tubes using an apparatus line for manufacturing seamless steel pipes and tubes, wherein
a steel raw material is heated by a heating apparatus,
the hollow material is formed by piercing the steel raw material by a piercing apparatus,
the hollow material is formed into a hollow piece by applying hot working by a rolling apparatus,
the hollow piece is cooled by the cooling apparatus, and
the steel raw material has the composition which contains, by mass %,
0.050% or less C, 2.00% or less Si,
5.00% or less Mn, 0.05% or less P,
0.03% or less S, 16.0 to 35.0% Cr,
3.0 to 12.0% Ni, 5.0% or less Mo,
0.1% or less Al, 0.5% or less N, and
Fe and unavoidable impurities as a balance, wherein
the steel raw material is heated to a temperature of ($\delta_A$−300° C.) to ($\delta_A$+100° C.) by the heating apparatus,
hot working is applied to the rolling apparatus, and
using a surface temperature of the hollow piece before being cooled by the cooling apparatus as a cooling start temperature, the cooling apparatus cools the hollow piece to a cooling stop temperature having a temperature difference of at least 50° C. or more from the cooling start temperature and being equal to or above 600° C. at an average cooling speed of 1.0° C./s or more in terms of an outer surface temperature.

2. The method of manufacturing duplex seamless stainless steel pipes and tubes according to claim 1, wherein
the hollow piece after cooling is made to pass through a heat-retention apparatus having a heating function.

3. The method of manufacturing duplex seamless stainless steel pipes and tubes according to claim 2, wherein
cooling is performed in the heat-retention apparatus at an average cooling speed of 1.0° C./s or less at a position on an outer surface of the hollow piece.

4. The method of manufacturing duplex seamless stainless steel pipes and tubes according to claim 2, wherein
heating is performed in the heat-retention apparatus at an average heating speed of 1.0° C./s or more at a position on an outer surface of the hollow piece.

5. The method of manufacturing duplex seamless stainless steel pipes and tubes in claim 1, wherein
the steel raw material further contains, in addition to the composition, by mass %, one, two or more kinds of elements selected from a group consisting of
3.0% or less Nb, 0.1% or less Ti,
3.0% or less V, 0.5% or less Zr,
3.5% or less W, 3.5% or less Cu,
0.05% or less REM, 0.01% or less B, and
0.1% or less Ca.

6. The method of manufacturing duplex seamless stainless steel pipes and tubes according to claim 3, wherein
the average heating speed at the position on the outer surface of the hollow piece by the heat-retention apparatus is set to 1.0° C./s or more.

7. The method of manufacturing a duplex seamless stainless steel pipes and tubes in claim 2, wherein
the steel raw material further contains, in addition to the composition, by mass %, one, two or more kinds of elements selected from a group consisting of
3.0% or less Nb, 0.1% or less Ti,
3.0% or less V, 0.5% or less Zr,
3.5% or less W, 3.5% or less Cu,
0.05% or less REM, 0.01% or less B, and
0.1% or less Ca.

8. The method of manufacturing a duplex seamless stainless steel pipes and tubes in claim 3, wherein
the steel raw material further contains, in addition to the composition, by mass %, one, two or more kinds of elements selected from a group consisting of
3.0% or less Nb, 0.1% or less Ti,
3.0% or less V, 0.5% or less Zr,
3.5% or less W, 3.5% or less Cu,
0.05% or less REM, 0.01% or less B, and
0.1% or less Ca.

9. The method of manufacturing a duplex seamless stainless steel pipes and tubes in claim 4, wherein
the steel raw material further contains, in addition to the composition, by mass %, one, two or more kinds of elements selected from a group consisting of 3.0% or less Nb, 0.1% or less Ti,
3.0% or less V, 0.5% or less Zr,
3.5% or less W, 3.5% or less Cu,
0.05% or less REM, 0.01% or less B, and
0.1% or less Ca.

10. The method of manufacturing a duplex seamless stainless steel pipes and tubes in claim 6, wherein the steel raw material further contains, in addition to the composition, by mass %, one, two or more kinds of elements selected from a group consisting of 3.0% or less Nb, 0.1% or less Ti,
3.0% or less V, 0.5% or less Zr,
3.5% or less W, 3.5% or less Cu,
0.05% or less REM, 0.01% or less B, and
0.1% or less Ca.

* * * * *